United States Patent [19]

Webster

[11] Patent Number: 5,060,332

[45] Date of Patent: Oct. 29, 1991

[54] CABLE STAYED BRIDGE CONSTRUCTION

[75] Inventor: David R. Webster, Wstmount, Canada

[73] Assignee: H. J. G. McLean Limited, Bantford, Canada

[21] Appl. No.: 541,821

[22] Filed: Jun. 21, 1990

[51] Int. Cl.[5] ..... E01D 11/00

[52] U.S. Cl. ..... 14/21; 14/20

[58] Field of Search ..... 14/19–21

[56] References Cited

U.S. PATENT DOCUMENTS 285,257 9/1883 Griffith ..... 14/21
413,172 10/1889 Clymer ..... 14/21
467,013 1/1892 Miller ..... 14/21
510,064 12/1893 Eddy ..... 14/19
2,059,693 11/1936 Hamilton ..... 14/20
2,878,498 3/1959 Gollnow ..... 14/19

*Primary Examiner*—Ramon S. Britts
*Assistant Examiner*—Nancy Connolly
*Attorney, Agent, or Firm*—Samuel Meerkreebs

[57] ABSTRACT

A cable stayed bridge which includes a pair of towers on either side of a gap and a roadway deck extending across the gap between the towers and cable stays fanning out from the top of each tower to separate longitudinally spaced load-bearing points on the decks such that a pair of cable stays extends from each load-bearing point on the deck to the tops of the respective towers with a span between towers 10 to 20 times tower height above the deck.

6 Claims, 2 Drawing Sheets

CABLE STAYED BRIDGE CONSTRUCTION

BACKGROUND OF THE INVENTION

1. Field of the Invention

The present invention relates to bridges, and more particularly, to a cable stayed suspension bridge.

2. Description of the Prior Art

Conventional suspension bridges are usually of the catenary type. Viewed from the side, the catenary bridge includes a cable suspended, in a catenary curve, between two towers, and a series of vertical cables suspending the deck of the bridge to the catenary cable The outline defined by a pair of adjacent vertical cables, with the respective portion of the catenary cable and the deck, is that of a quadrilateral polygon. A quadrilateral is an unstable shape for a frame, leaving catenary bridges well known for instability, subject to deformation waves that reflect from end to end of a bridge. When periodic loads, such as wind gusts, correspond to a natural harmonic of a catenary bridge, the resultant resonance can pose a danger to the bridge. Therefore, heavy trusses are added for stiffness, but their added weight and cost do not contribute directly to bridging a gap. The longer the span, the greater the possibility of harmful vibrations, and the quadrilateral, therefore, imposes limits on possible catenary spans.

A less known type of suspension bridge is a stayed bridge. West German Auslegeschrift 1,235,973, published Mar. 9, 1967, and U.K. Patent Application GB 2,109,040 A, published May 25, 1983, describe one such type of stayed bridge, while Swedish Patent 179,453, published Mar. 29, 1962, illustrates a more complex stayed suspension bridge. Both of these types of stayed bridges have, in side view, a series of vertical outlines shaped as triangles, each framed by a stay, a tower, and a deck portion. A triangle is a stable shape for a frame, assuming stiff sides or at least no compression in a flexible side, leaving stay bridges well known for stability. However, a disadvantage of existing stayed bridges is longitudinal compression in a deck that requires compressive capacity to be added to a deck, but the added weight and cost do not contribute directly to bridging a gap. The longer the span, the greater the deck compression, and the compression, therefore, imposes limits on span lengths with stays.

A bridge, whether catenary or stayed or any other type, has an obvious need to support its own dead weight plus live loads including wind and earthquake loads. Also, any bridge has a limit of span imposed by a given design based on a limit of strength imposed by given materials, of construction.

The disadvantage of quadrilateral instability, and the resultant need for a weight of stiffening trusses, all restrict a conventional catenary span to 5 to 10 times the height of tower above deck.

SUMMARY OF THE INVENTION

An object of the present invention is to keep the best features and avoid the worst features of both a catenary and a stayed bridge. Accordingly, an object of the invention is to have the advantage of no compression in the deck of a catenary bridge, and the advantage of triangular stiffness in a stayed bridge. By corollary, another object is to avoid the disadvantage of quadrilateral instability in a catenary bridge, and to avoid the disadvantage of longitudinal compression in the deck of a stayed bridge.

The advantage of triangular stability, and the resultant reduction of bridge weight, all help this invention span to reach more like 10 to 20 times the height of tower above deck.

It is a further object of the present invention to have a lightweight bridge construction which will permit the use of relatively small diameter cables.

A construction in accordance with the present invention comprises a cable stayed bridge including at least a pair of towers, one erected from a base on either side of the area to be spanned. Cable means are provided for suspending a roadway deck between the bases of the towers. Means identifying load-bearing points are spaced longitudinally of the roadway deck which is made up at least of rigid segments. The cable means includes a pair of cable stays extending from each load-bearing point, one to each tower. The cable stays are fixed at each load-bearing point to a rigid segment of the deck. Anchor means are provided remote from each tower relative to the span between the towers and anchor cable stays extend from each anchor means to a respective tower.

In a more specific embodiment of the present invention, the load-bearing point of each deck segment is at the point of equilibrium of the axial forces acting on the pair of stays and the force of gravity acting on the deck segment.

In a still more specific embodiment of the present invention, a second pair of towers is provided, such that one from each pair is erected at locations corresponding to each side of the roadway deck at each end of the deck, and each roadway deck segment has a load-bearing point selected at each end of a deck segment, and a pair of cable stays extends to respective towers from each load-bearing point in two longitudinal, vertical planes.

An advantage of the structure defined is that each deck segment, be it separate or part of a continuous deck, is suspended independently of the other segments, and each segment is suspended at the point of equilibrium of the intersecting forces, i.e., of the respective stays and the weight of the segment. Thus, there is no apparent longitudinal compression as with conventionally stayed bridges, and there remains a stable triangle of forces defined by each stay, the tower, and the respective deck.

A catenary has substantial displacement at a load point because load is applied non-axially. A stay, by contrast, has negligible displacement at a load point because the load is applied axially, and displacement is limited to the mere stretch of the stay cable.

A catenary bridge has an advantage of negligible horizontal thrust in a deck, but a disadvantage of instability because of non-axial loading, all requiring stability to be added in the usual form of heavy trusses.

A stayed bridge has the opposite, namely, an advantage of stability because of axial loading on stays, but a disadvantage of longitudinal thrust in a deck, all requiring compressive capacity to be added in the usual form of stronger deck members. The added weight and cost do not contribute directly to spanning a gap.

In this invention, a single load point per catenary makes each deck portion independent of other deck portions, because each deck portion has an independent catenary. Each deck portion is a free body, independent of loads at other deck portions, and is in a fixed position.

In contrast, a catenary bridge has each deck portion share a catenary cable, with consequent disturbances of deck position with changes of loads.

The necessary trusses of a catenary bridge may be omitted in this invention. The necessary compressive capacity of a stayed deck may be omitted in this invention.

For structural analysis, each deck portion of this invention may be treated as a free body, suspended through its center of gravity. For physical construction, each deck portion may be treated as a free body, supported at its ends. Whether treated as supported at the center of gravity, or at ends, the spacing of load points and the loads are the same.

A continuous deck is preferred for rigidity and economy of construction, rather than a segmented deck. Omission of side trusses found in a catenary bridge, and omission of deck compressive capacity found in a stayed bridge, both lighten the weight of the cable-stayed bridge of the present invention without sacrificing stability or load capacity.

The structure according to the present invention provides a constant pendulum length. In the case of side sway, when wind gusts can swing a catenary bridge sideways, as a pendulum pivoted at each tower top, the pendulum length varies from zero at tower to a maximum at mid span. Wind gusts swing a cable-stayed bridge of the present invention sideways, as a pendulum pivoted at each tower top, but the pendulum length is constant and equal to the tower height. In the case of a catenary bridge, side sway introduces a slight centrifugal force, varying from zero at tower to a maximum at mid span. A catenary being flexible, the catenary, therefore, deflects downward at the bottom of swing and becomes zero at the end of swing. Side swing being periodic and generated by wind gusts, a catenary bridge has the risk of a natural period of the bridge coinciding with a period of the wind gusts to cause resonance.

Another advantage of the present invention is a virtual elimination of deck side tilt and twist. In a catenary bridge, two parallel catenaries may vibrate out-of-phase with each other, causing the deck to rise at one side and to fall at the other side. In the bridge according to the invention, each cable has load points at a fixed level not prone to sag, aside from cable stretch, and during side sway both sides of a deck have a common increment of pendulum swing. Therefore, cables at either side of the deck are similar to pendulums in phase, and in end view of the bridge, the side sway has the deck swaying as the bottom member of a parallelogram. The swaying deck remains level, without tilt.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
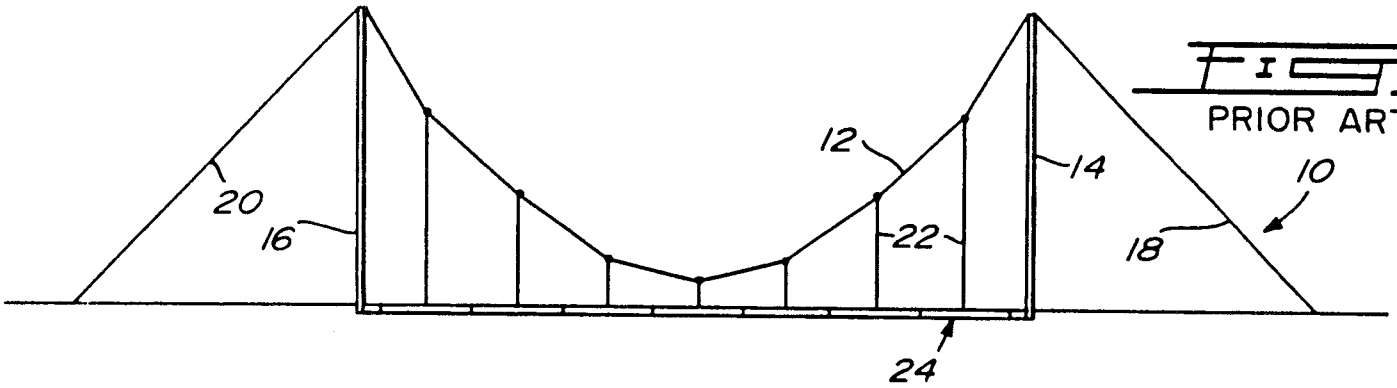
FIG. 1 PRIOR ART
FIG. 1 is a schematic side elevation of a conventional catenary bridge.

Referring now to FIG. 1 which illustrates a catenary bridge 10 in accordance with the prior art, the bridge 10 includes towers 14 and 16 between which is suspended a catenary cable 12. Anchor cables 18 and 20 extend from the top of the towers 14 and 16 to suitable anchor points remote from the towers. Vertical hanger cables 22 extend from points on the catenary cable 12 to the deck 24 of the bridge. As can be seen, the outline between each adjacent hanger cable 22 is that of a quadrilateral formed with the segment of the catenary cable 12 and deck 24. This structure provides for a very unstable suspension in that the quadrilateral can be deformed relatively easily, and this, of course, is evident from existing suspension bridges of the catenary type. Such bridges have been known to self-destruct in high winds because of a wave pattern being formed in the deck which is resonant with the natural frequency of the bridge structure.

Figure 3:
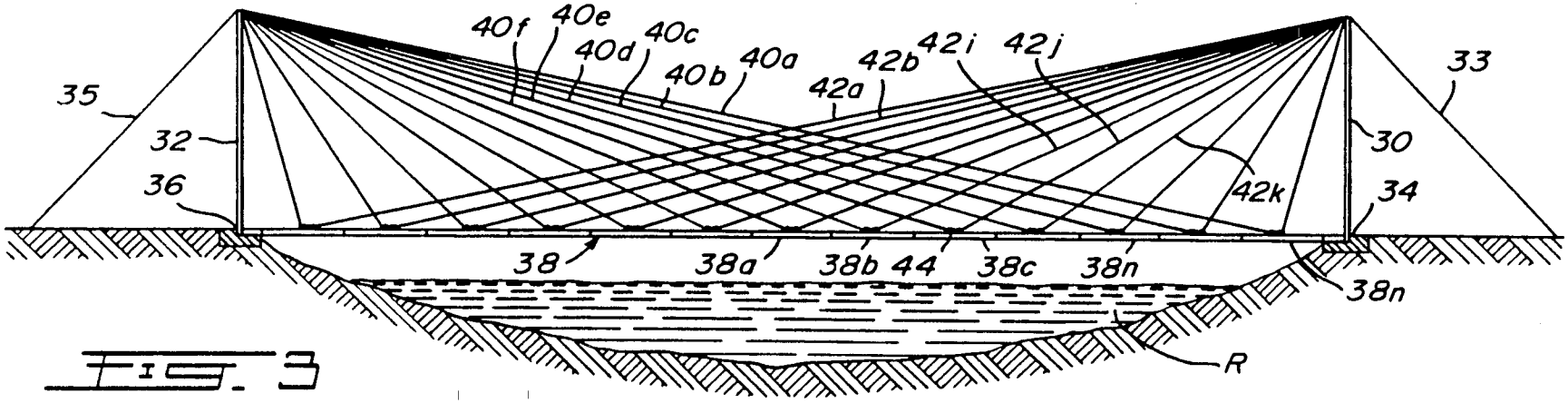
FIG. 3 is a schematic side elevation of a bridge in accordance with the present invention.

A cable stayed bridge in accordance with the present invention includes, as shown in FIG. 3, vertical towers represented in the drawing by numbers 30 and 32 on either side of a river R to be spanned. The towers 30 and 32 are mounted on bases 34 and 36 while anchor cable stays 33 and 35 extend from the top of the respective towers 30 and 32 to suitable anchor points on the ground remote from the bridge. A deck 38 made up of individual deck segments 38*a*, 38*b*, 38*c* to 38*n*, extends between the bases 34 and 36, and for each deck segment 38*a* . . . 38*n*, there is provided a load point represented by the bracket 44.

In other words, several longitudinally spaced load points are determined, and individual cable stays 40 and 42 are suspended from the respective towers 32 and 30 to the attachment bracket 44. Thus, from tower 32, a plurality of individual cable stays 40*a*, 40*b*, . . . 40*n* extend from the top thereof to individual attachment brackets 44 at load-bearing points of the deck portions 38*a*, 38*b*, . . . 38*n* set out between bases 34 and 36. A series of cables 42*a* through 42*n* fan out from the top of tower 30 to deck portions 38*a*, 38*b*, . . . 38*n* of the deck at the brackets 44. Preferably, the series of cables 40, 42 would be substantially within a vertical plane which includes the towers 30 and 32. Thus, the roadway deck 38 can be seen as a series of longitudinal portions 38*a*, 38*b*, . . . 38*n* with each portion 38 being individually supported by cable stays 40 and 42. For instance, a typical deck portion 38*b* would be supported by cable stay 40*f* and 42*i*. These respective cable stays would be fixedly connected at bracket 44 on the deck portion 38*b*.

Figure 2:
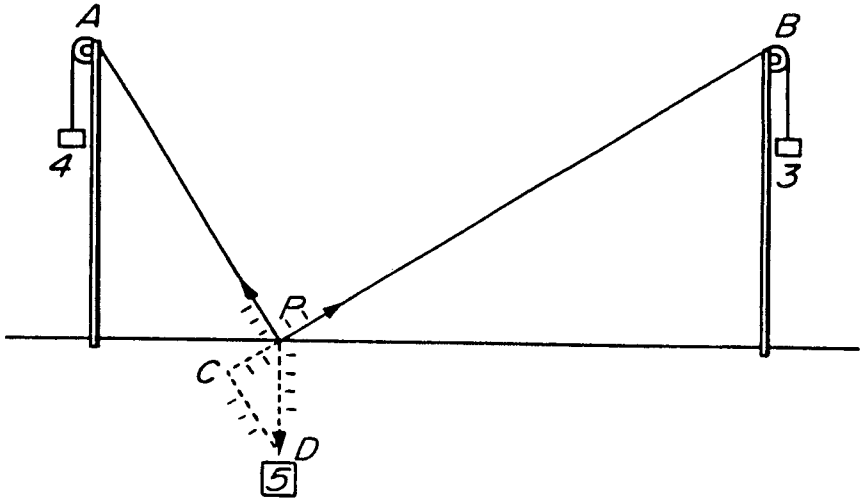
FIG. 2 is a diagram of forces with respect to the structure used in the present invention.

An analysis of the forces retaining each deck segment 38 is illustrated in FIG. 2. The load-bearing point of each segment 38 is at the point of equilibrium of the cable stays 40 and 42. In FIG. 2, this point is identified at P, and the tops of the respective towers are identified by the letters A and B. As shown, if the deck segment represents five units of force (gravity), the force generated through cable 40 as represented by line AP would be four units, and the cable 42 represented by line PB would be three units. The vector triangle is illustrated in FIG. 2 as PCD.

Since the cable stays 40 and 42 represent with the respective towers 30, 32 and the deck 38 a triangular structure for each support point P and the support point is at the point of equilibrium of the forces generated through cables 40 and 42, the deck portions 38 will be supported with the maximum of stability for a suspension type structure.

Figure 4:
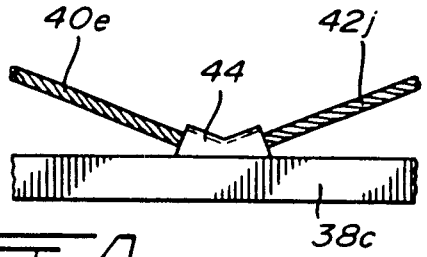
FIG. 4 is an enlarged fragmentary side elevation of a detail shown in FIG. 3.

FIG. 4 illustrates a simplified illustration of the bracket 44. As shown in this example, each cable stay 41*e* and 42*j* would be fixedly connected to bracket 44. The cable stays 41*e* and 42*j* could be a continuous cable extending as a catenary from the top of the towers 30 and 32 and being fixedly attached at bracket 44 to the deck segment 38*c*. As previously indicated, the deck 38 may be a continuous rigid roadway deck, or it could be a series of transversely extending deck panels linked to each other in the longitudinal direction of the roadway. In either case, for the purposes of analysis of the structure, each deck portion is considered as a separate load-bearing deck segment which is held suspended in equilibrium by the cable stays 40 and 42.

It would be of advantage in the construction of a bridge in accordance with these principles to have relatively high towers 30 and 32 so that the angles of the cable stays, particularly in a long span, could be kept as high as possible, that is, to avoid having too shallow an angle between the bracket 44, the deck 38, and either cable stay 40 or 42.

It is evident that FIG. 3 is a schematic side view of a typical bridge but that a mirror image of the structure shown in FIG. 3 would be provided on either side of a roadway deck such that there would be two towers 32 and a pair of towers 30 with cables 40 and 42 fanning out from the top of each tower on either side of the roadway deck 38.

I claim:

1. A cable stayed bridge comprising at least a pair of towers, one of the pair being erected from a base on either side of an area being spanned, cable means being provided for suspending a roadway deck between the bases of the pair of towers, the roadway deck comprising rigid deck segments forming a continuous roadway deck, means defining load-bearing points with at least one load-bearing attachment point for each deck segment; the cable means including a pair of cable stays extending from each load-bearing attachment point on a deck segment, one stay to the top of each tower of the pair, the cable stays being fixedly connected at each load-bearing attachment point to the respective deck segment, an anchor means provided remote from each tower relative to the span between the towers, and anchor cable stays extending from the anchor means to a respective tower whereby the continuous deck is supported solely by the cable means.

2. A cable stayed bridge in accordance with claim 1, wherein the load-bearing point of each deck segment is at the point of equilibrium of the axial forces acting on the respective pair of stays and the force of gravity acting on the deck segment.

3. A cable stayed bridge as defined in claim 1, wherein two pairs of towers are provided with one pair at either side of the roadway deck, the cable stays fanning out from the top of each tower in vertical planes, each plane including one of said pair of towers, the cable stays being fixedly attached at separate load-bearing attachment points of the respective deck segments.

4. A cable stayed bridge structure as defined in claim 2, wherein a bracket is provided at the load-bearing attachment point on each deck segment to which the cable stays extending to the top of each tower are fixedly connected.

5. A cable stayed bridge structure as defined in claim 3, wherein a bracket is provided at the load-bearing attachment point on each deck segment to which the cable stays extending to the top of each tower are fixedly attached.

6. A cable stayed bridge structure as defined in claim 3, wherein the deck comprises a plurality of laterally extending rigid segments in side-by-side relationship and corresponding load-bearing attachment points are fixedly located on each segment.

* * * * *